United States Patent [19]

Pace

[11] 4,432,504

[45] Feb. 21, 1984

[54] HOLDER AND DISPENSER FOR BATHROOM TISSUE ROLLS

[76] Inventor: Ron L. Pace, 217 S. 2nd West, Wellsville, Utah 84339

[21] Appl. No.: 239,396

[22] Filed: Mar. 2, 1981

[51] Int. Cl.[3] ..... B65H 19/00

[52] U.S. Cl. ..... 242/55.2; 24/31 V

[58] Field of Search ..... 242/96, 55.2, 55.3, 242/55.54; 224/183, 250; 225/46, 47; 312/38–40; 2/DIG. 6; 24/73 MS, 49 M, 31 V, 201 B; 211/DIG. 1

[56] References Cited

U.S. PATENT DOCUMENTS

| | | | |
|---|---|---|---|
| 1,136,700 | 4/1915 | Moore | 242/55.2 |
| 1,269,411 | 6/1918 | Edwards | 242/55.2 |
| 1,354,170 | 9/1920 | Cook | 242/55.2 |
| 1,618,342 | 2/1927 | Kirkman | 242/55.2 |
| 2,152,426 | 3/1939 | Wilson | 242/55.2 |
| 2,525,992 | 10/1950 | Wynn | 242/96 |
| 2,529,420 | 11/1950 | Ramquist | 242/55.2 |
| 2,561,972 | 7/1951 | Cederberg | 242/55.2 |
| 3,022,957 | 2/1962 | Blunt et al. | 242/55.2 |
| 4,233,586 | 11/1980 | Kaplow et al. | 335/303 |
| 4,236,658 | 12/1980 | Kallman | 224/250 |

FOREIGN PATENT DOCUMENTS

| | | | |
|---|---|---|---|
| 197797 | 3/1923 | United Kingdom | 242/55.2 |

*Primary Examiner*—Leonard D. Christian
*Attorney, Agent, or Firm*—A. Ray Osburn

[57] ABSTRACT

A holder and dispenser for a bathroom tissue roll comprising a stationary, unrotatable spindle extending perpendicularly away from the bathroom wall. The spindle is not removed from the holder to install the roll. A retractable member is provided to retain the roll upon the spindle in freely rotatable relation thereto. The roll retainer is releasably attached to the end of the spindle as by Velcro patches, and may be rotated away from the spindle to allow unimpeded installation of the roll therearound. The holder and dispenser is advantageously constructed substantially of a monolithic plastic molding comprising the spindle and a plate adapted to be secured to the bathroom wall.

5 Claims, 5 Drawing Figures

HOLDER AND DISPENSER FOR BATHROOM TISSUE ROLLS

BACKGROUND OF THE INVENTION

1. Field

The invention is in the field of bathroom tissue roll holders and dispensers.

2. State of the Art

Most prior bathroom tissue dispensers carry the tissue roll on a removable rotating spindle generally having end pivot pins held between a pair of spaced apart brackets mounted to extend outwardly from the bathroom wall adjacent to the commode. The spindle must be removed and replaced to replenish depleted tissue rolls. Most commonly, the spindle has two separate, tandemly arranged, slideably connected sections held extended apart by built-in compression spring means. The sections must be manually pressed together to shorten the spindle for removal and installation within the holder. Such spindles are complicated and expensive, and require considerable manual dexterity for their removal and installation. The brackets are stressed repeatedly and tend to be loosened from the wall. Sometimes, a monolithic spindle is used, requiring that the brackets be sprung apart for its installation and removal, stressing the wall brackets even more severely. In some designs with such constant length pintles, an upwardly opening slot is provided in one or both of the brackets, to receive the end pivot pins provided on the spindle. All of these designs must be constructed and installed with considerable precision and care to prevent the irritation from premature tearing of the tissue from binding of either the spindle or the roll. Conversely, the spindle and roll also often tend to rotate so freely that unwanted lengths of tissue strip are unwound by the rotational inertia of the roll. This additional tissue is either wasted if used unnecessarily, or untidy if left unused pending from the roll. These dispensers position the spindle and roll parallel to the wall beside the commode. To avoid premature tearing, the tissue strip must be withdrawn inconveniently by motion of the user's hand in a plane perpendicular to the wall, so that sideward premature tearing of the strip is frequent. Often, the strip must be repeatedly gripped to unwind the desired length of tissue by repeated short uneven motions, further increasing the likelihood of premature tearing of the strip from the roll.

BRIEF SUMMARY OF THE INVENTION

With the foregoing in mind, the invention eliminates or substantially alleviates the disadvantages of present bathroom tissue dispensers by providing such a dispenser with a spindle adapted to be permanently affixed longitudinally outstanding from the bathroom wall, along with means for retaining the tissue roll freely rotatable therearound, said means being retractable for easy installation and removal of the tissue roll upon the spindle. The spindle is stationary, does not rotate with the roll, and is not removed for installation of the roll. The foregoing disadvantages attendent to installation and removal of the spindle and tissue roll are thus completely eliminated, and the tissue may be unwound from the roll without premature tearing, by a smoothly natural downward motion of the user's hand parallel to his body and the wall adjacent to the commode. Light friction between the central perforation of the roll and the stationary spindle prevents runaway rotation of the roll, while permitting the tissue strip to be unwound without tearing. The roughness of the surface of the spindle may advantageously be selected for the desired degree of restraint to rotation of the roll, as by roughening or smoothing as required.

BRIEF DESCRIPTION OF THE DRAWINGS

In the drawings, which represent the best mode presently contemplated for carrying out the invention.

DETAILED DESCRIPTION OF ILLUSTRATED EMBODIMENTS

Figure 1:
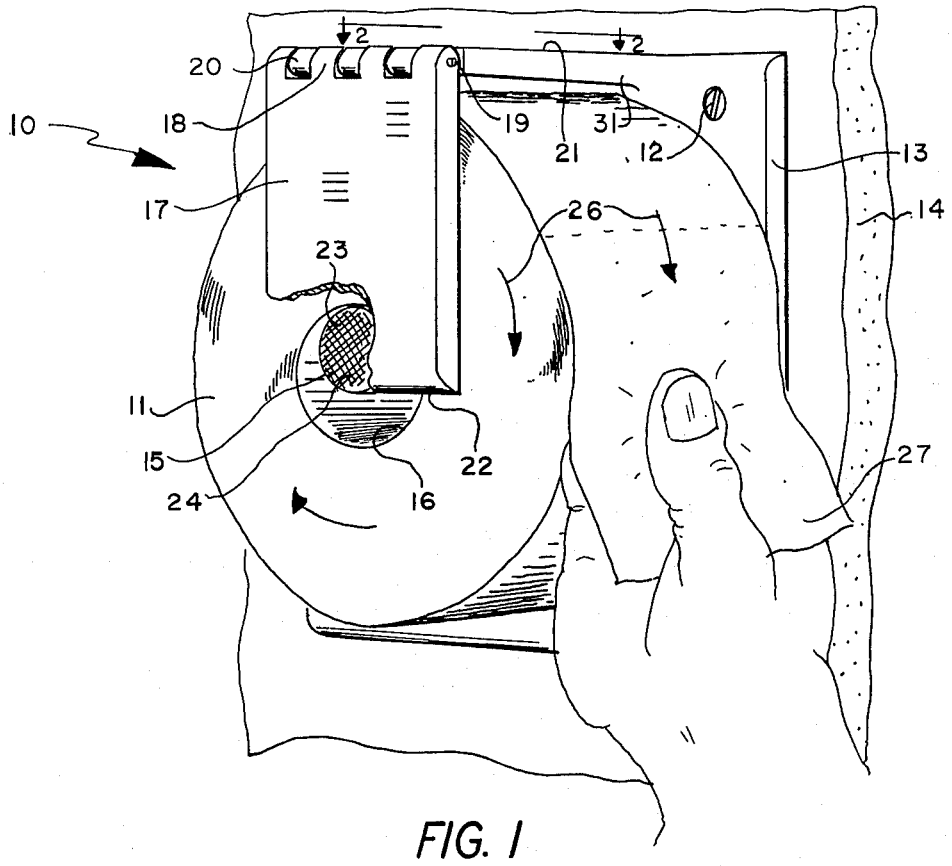
FIG. 1 is a partially cut-a-way perspective of a tissue holder and dispenser in accordance with the invention, drawn slightly smaller than full scale, and showing also a tissue roll installed therein, FIG. 2 a top plan view taken along line 2—2 of FIG. 1 and drawn to the same scale, FIG. 3 a sectional view taken along line 3—3 of FIG. 2 and drawn to the same scale, FIG. 4 a sectional view taken along line 4—4 of FIG. 3 and drawn to the same scale, and FIG. 5 a fragment of a sectional view of the tissue holder and dispenser showing a second preferred embodiment of the releasable attachment of the roll retainer to the end of the spindle, drawn to the scale of FIG. 1.
Figure 2:
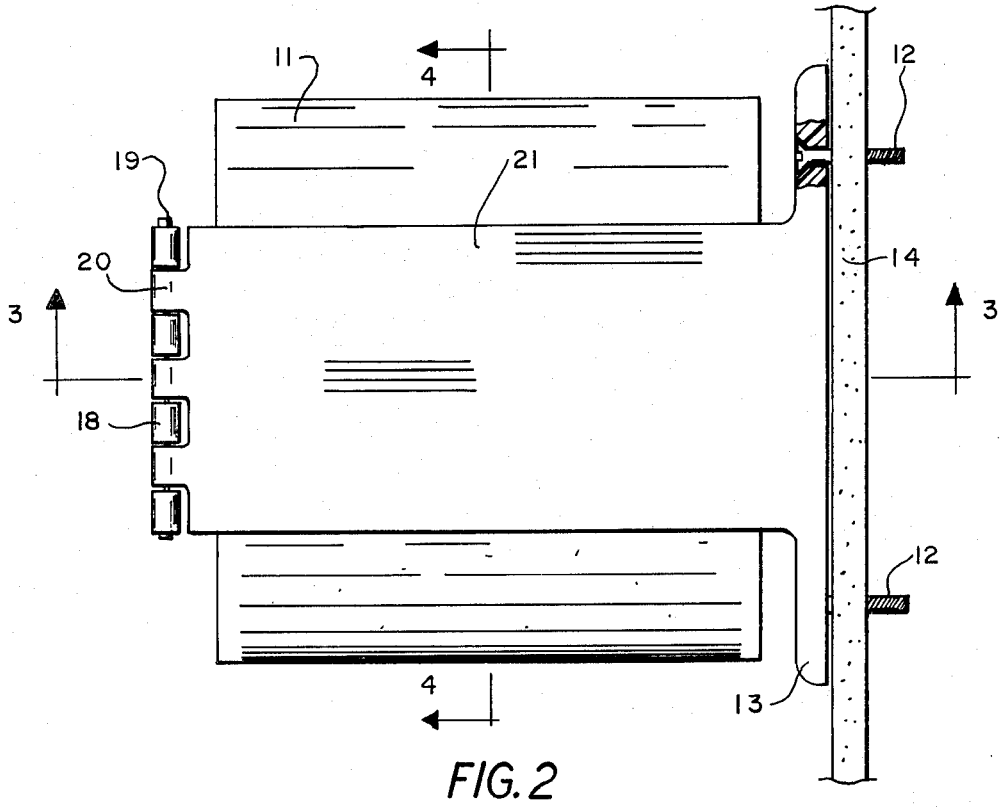
Figure 3:
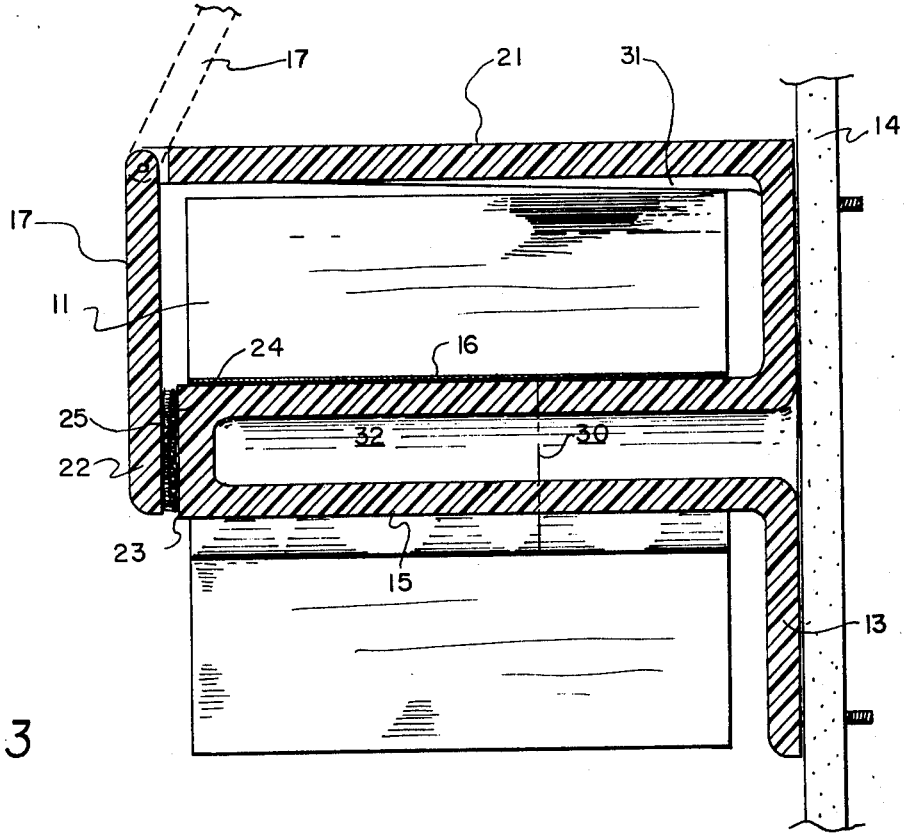
Figure 4:
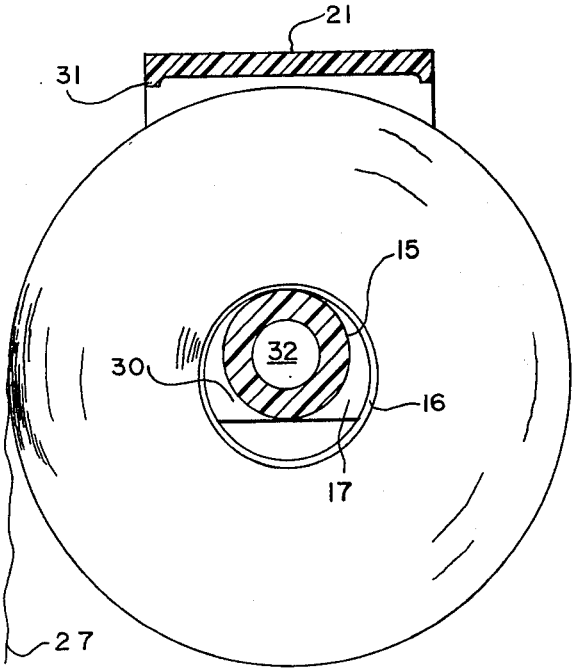
Figure 5:
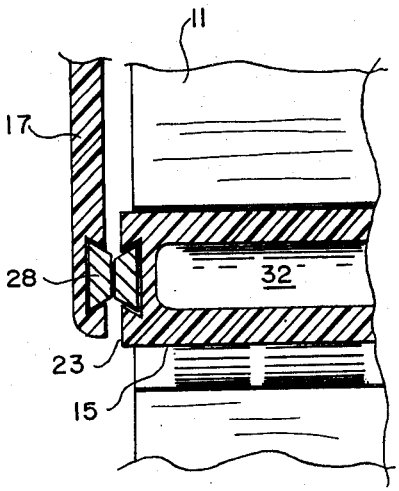

A preferred embodiment of the bathroom tissue roll holder and dispenser 10 is shown in FIGS. 1–4, carrying a tissue roll 11, and attached by countersunk screws 12 through a wall mounting plate 13 to a bathroom wall 14. A roll carrying cylindrical spindle 15 extends outwardly from wall plate 13 through substantially larger roll core tube 16. A retractable roll retainer plate 17 is provided, with ears 18 hinged through a pin 19 to matching ears 20 of hinge plate 21 projecting normally from wall plate 13 above roll 11. At its lower end 22, retainer 17 is releasably secured to the outermost end 23 of spindle 15, as by matching interlocking Velcro patches 24 and 25, which are secured as by bonding to ends 23 and 22 respectively. Retainer 17 provides the small restraint needed to prevent tissue roll 11 from working outwardly off spindle 15 as it is rotated (arrows 26) by withdrawal of tissue strip 27. By breaking the light bond between the Velcro patches, roll retainer 17 may be rotated to a retracted position above hinge plate 21, (FIG. 3), to provide for unobstructed removal of core tubes 16 of depleted rolls, and for subsequent placement of full rolls 11 about spindle 15. The Velcro bond may be restored by light pressure upon retainer end 22, after retainer 17 is rotated back into vertical, roll retaining position. Another releasable securing means comprises a magnet 28 secured within retainer end 22 along with a magnetic metal tab 29 within spindle end 23. (FIG. 5) Releasable mechanical or spring means, not illustrated, could also be employed, but are not preferred.

Since the outer diameter of spindle 15 is substantially smaller than the inside diameter 30 of core tube 16, roll 11 will turn freely without binding upon spindle 15, without premature tearing of strip 27 when it is drawn from the roll. However, the light friction between rotating core tube 16 and stationary pintle 15 serves to restrain the roll from "run-away" rotation causing unwanted tissue strip 27 to be unwound. While not generally required, spindle 15 may if necessary be fabricated to have the surface roughness appropriate for free roll rotation without run-away. Premature tearing also tends to be prevented by the position in which spindle 15 is usually installed, outstanding from wall 14 beside the commode. The user tends to unroll tissue strip 27, without any sideway tearing motion, by a single smooth natural motion of his hand and arm perpendicular to roll 11 in the unobstructed space between the commode and wall 14.

While other constructions may be employed, that illustrated is preferred, with spindle 15, wall plate 13, and hinge plate 21 formed together as a monolithic plastic molding, including hinge ears 20 with axially aligned hinge pin perforations. Side ribs 31 may be provided on hinge plate 21 to enhance its strength and dimensional stability. A spindle cavity 32 may be incorporated to conserve material while facilitating the molding process by reducing the tendency for shrinkage cracking by eliminating abrupt changes in material thickness at its juncture with wall plate 13. Roll retainer 17 may similarly be constructed of molded plastic to include perforated hinge ears 18.

The invention may be embodied in other specific forms without departing from the spirit or essential characteristics thereof. The present embodiment is therefore to be considered in all respects as illustrative and not restrictive, the scope of the invention being indicated by the appended claims rather than by the foregoing description, and all changes which come within the meaning and range of equivalency of the claims are therefore intended to be embraced therein.

What is claimed and desired to be secured by U.S. Letters Patent is:

1. An apparatus adapted for holding and dispensing bathroom tissue from a roll of a strip thereof, said roll enclosing a central tubular core therethrough normal to the strip, and said apparatus comprising:

a wall mounting plate adapted to be secured with a flat wall side thereof against the surface of a bathroom wall;

a cylindrical spindle being integral with the wall mounting plate and outstanding normally therefrom away from the wall, said spindle being of substantially smaller outside diameter than the inside diameter of the central tubular core of the roll, and being outstanding from the plate at least a distance slightly greater than the width of the roll;

a hinge member being integral with the wall mounting plate and outstanding normally therefrom away from the wall, and outstanding from the plate a distance at least slightly greater than the width of the roll, and spaced away from the spindle a distance sufficient to clear a roll placed thereabout;

a roll retaining member spanning between the ends of the spindle and the hinge member remote from the wall plate;

hinge means connecting said end of the hinge member with the end of the roll retaining member proximate thereto, said hinge means permitting the retaining member to be rotated away from the spindle to permit placement and removal of the roll to about and from about the spindle respectively; and means for releasably securing the spindle end of the roll retaining member to said end of the spindle.

2. The apparatus of claim 1, wherein:

the means for releasably securing the roll retaining member to the spindle comprises a Velcro patch secured to the spindle end and a matching Velcro patch secured to the roll retaining member.

3. The apparatus of claim 1, wherein:

the means for releasably securing the roll retaining member to the spindle comprises magnet means.

4. The apparatus of claim 1, wherein:

the means for releasably securing the roll retaining member to the spindle comprises mechanical means.

5. The apparatus of claim 1, wherein:

the wall mounting plate, the spindle and the hinge member are all of a single monolithic plastic molding.

* * * * *